US008168904B2

(12) United States Patent
Huang

(10) Patent No.: US 8,168,904 B2
(45) Date of Patent: May 1, 2012

(54) ILLUMINATION BUTTON SWITCH ASSEMBLY HAVING LIGHTING STRUCTURE AND ELECTRONIC DEVICE

(75) Inventor: Yu-Hsin Huang, Taipei Hsien (TW)

(73) Assignee: Wistron Corp., Hsichih, Taipei Hsien (TW)

( * ) Notice: Subject to any disclaimer, the term of this patent is extended or adjusted under 35 U.S.C. 154(b) by 366 days.

(21) Appl. No.: 12/542,334

(22) Filed: Aug. 17, 2009

(65) Prior Publication Data

US 2010/0314228 A1 Dec. 16, 2010

(30) Foreign Application Priority Data

Jun. 10, 2009 (TW) ..... 98210307 U

(51) Int. Cl.
*H01H 9/00* (2006.01)

(52) U.S. Cl. ..... 200/314

(58) Field of Classification Search ..... 200/310–314, 200/341–345, 293–296, 521; 362/296.01
See application file for complete search history.

(56) References Cited

U.S. PATENT DOCUMENTS

| | | | | |
|---|---|---|---|---|
| 5,252,798 | A * | 10/1993 | Kamada | 200/314 |
| 7,244,898 | B2 * | 7/2007 | Kim | 200/314 |
| 2005/0274593 | A1 * | 12/2005 | Kawano | 200/314 |
| 2006/0201796 | A1 * | 9/2006 | Ostendorf et al. | 200/314 |

FOREIGN PATENT DOCUMENTS

| | | |
|---|---|---|
| TW | I239543 | 9/2005 |
| TW | 200717559 | 5/2007 |
| TW | M312129 | 5/2007 |

* cited by examiner

*Primary Examiner* — Edwin A. Leon
(74) *Attorney, Agent, or Firm* — Muncy, Geissler, Olds & Lowe, PLLC

(57) ABSTRACT

An illumination button switch assembly for an electronic device includes a substrate, a switch element, a flexible and light-pervious supporting member, a light source, and a button cap. The switch element is disposed on the substrate to be triggered to generate a switching signal. The supporting member has a top end and a bottom end, a concave hollow portion is formed on the bottom end, and the bottom end is disposed above the switch element and is spaced from the switch element. The light source is disposed on the substrate to project light into the hollow portion. The button cap is fixed on the top end to be pressed to push the supporting member to contact the switch element with the bottom end. Since the button cap is light-pervious, the light passing through the hollow portion penetrates the button cap, thereby illuminating the button cap.

24 Claims, 9 Drawing Sheets

ILLUMINATION BUTTON SWITCH ASSEMBLY HAVING LIGHTING STRUCTURE AND ELECTRONIC DEVICE

CROSS-REFERENCES TO RELATED APPLICATIONS

This non-provisional application claims priority under 35 U.S.C. §119(a) on Patent Application No. 98210307 filed in Taiwan, R.O.C. on Jun. 10, 2009, the entire contents of which are hereby incorporated by reference.

BACKGROUND

1. Technical Field

The present invention relates to a button switch assembly, and more particularly to an illumination button switch assembly and an electronic device having the illumination button switch assembly.

2. Related Art

Button switch assemblies are widely applied in various electronic devices. A button switch assembly is provided to be pressed to generate a corresponding switching signal, such that an electronic device performs a corresponding action.

When the electronic device is operated under insufficient illumination, a user usually cannot quickly recognize positions of buttons and marks on the buttons. Therefore, the user cannot correctly operate the buttons. In order to solve the above problem, various button illumination assemblies are introduced in the prior art to illuminate the buttons.

For example, Taiwan Publication No. 200717559 disclosed a keypad. The keypad includes a flexible light guiding plate, and a key pattern and a passivation layer f are disposed on the flexible light guiding plate to form a thin film keypad. When the keypad is pressed, a switching signal is generated. Light is projected onto the flexible light guiding plate through a light source and a reflector, so as to illuminate the thin film keypad. The keypad in No. 200717559 is a thin film keypad with key caps (button caps), therefore the problem for illuminating key caps (button caps) is not solved. Meanwhile, the reflector requires additional space and increases the cost of the keypad.

Taiwan Patent No. I239543 disclosed a button illumination module. A light source and a light-guiding button cap are disposed on a key substrate, and a diffusion sheet is disposed inside the button cap. The button cap covers the light source for receiving light and allowing the light to travel through the button cap. Therefore, the top surface of the button cap is illuminated. The button illumination module in I239543 further includes an elastic member to keep a gap between the button cap and a switch element constantly. To prevent the elastic member from blocking a traveling path of the light, the elastic member is disposed on a periphery of the button cap, such that a space occupied by the button illumination module is increased.

Taiwan Utility Model Patent No. M312129 disclosed a push button device having a light-emitting structure, in which a sheet is disposed on a circuit board, and a plurality of conductive reeds is disposed on the sheet. Actuators are disposed above the sheet, and correspond to the conductive reeds. Plural buttons are disposed on the actuators. When any of the buttons is pressed, the corresponding actuator is pressed by the button, and then a corresponding conductive reed is pressed by the actuator to generate a switching signal. The push button device in M312129 further includes a light-guiding film disposed above the actuators and the sheet to guide the light to illuminate the keys. However, the push button device in M312129 is only applicable to thin film button, and can only illuminate all the buttons at the same time rather than illuminating a single button.

SUMMARY

The present invention is directed to an illumination button switch assembly, which has a compact structure and is capable of lighting a single key.

The present invention provides an illumination button switch assembly, which includes a substrate, a switch element, a flexible and light-pervious supporting member, a light source, and a button cap. The switch element is disposed on the substrate to be triggered to generate a switching signal. The supporting member has a top end and a bottom end opposite to the top end. A concave hollow portion is formed on the bottom end forms, and the bottom end is disposed above the switch element and is spaced from the switch element. The light source is disposed on the substrate and corresponds to the bottom end of the supporting member. The light source is used to project a light into the hollow portion. The button cap is fixed on the top end of the supporting member, and is pressed to push the supporting member to contact the switch element with the bottom end. At least a part of the button cap is light-pervious, such that the light passing through the hollow portion penetrates the button cap, thereby lighting the button cap.

In one or more embodiments of the present invention, the illumination button switch assembly is disposed in a casing, and the button cap is exposed from a button hole of the casing, such that the button cap is pressed by a user. In this way, an electronic device having an illumination button switch is implemented.

In the present invention, the supporting member of the button cap serves as a supporting structure and a light guiding structure sumptuously, and no additional elements are required to guide light. The button cap, the supporting member, and the light source are approximately disposed in a same vertical axis, thereby substantially reducing a space occupied by the illumination button switch assembly. Therefore, a large number of buttons may be disposed, and each button has one or more exclusive light sources to illuminate the button.

BRIEF DESCRIPTION OF THE DRAWINGS

The present invention will become more fully understood from the detailed description given herein below for illustration only, and thus are not limitative of the present invention, wherein.

DETAILED DESCRIPTION

Figure 1:
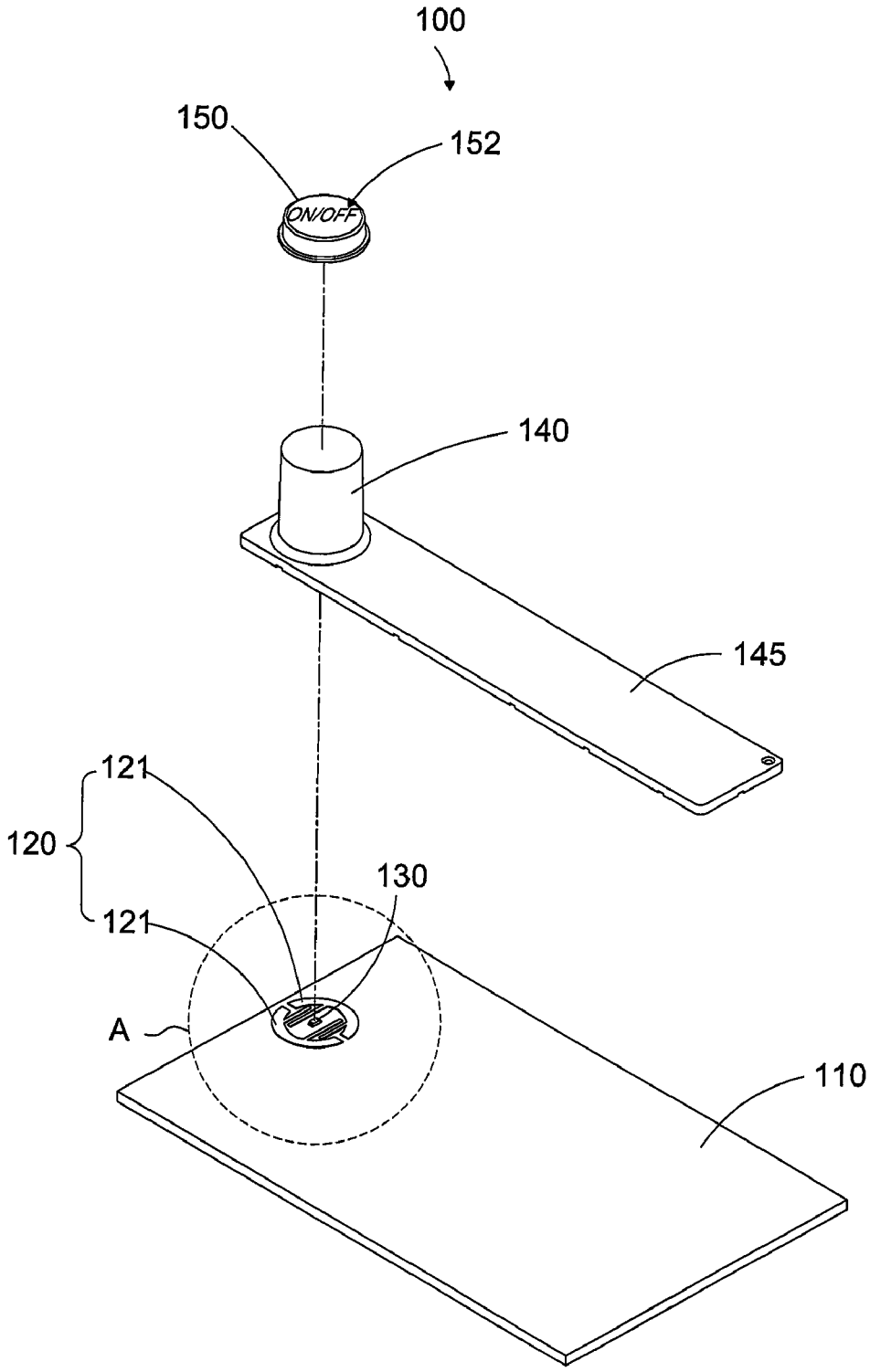
FIG. 1 is an exploded view according to a first embodiment of the present invention.

Referring to FIGS. 1, 2, 3, and 4, an illumination button switch assembly 100 according to a first embodiment of the present invention is shown. The illumination button switch assembly 100 is applicable to an electronic device. In the illumination button switch assembly 100, the button is illuminated to attract attention. The illumination button switch assembly 100 includes a substrate 110, a switch element 120, a light source 130, a flexible and light-pervious supporting member 140, and a button cap 150.

Referring to FIGS. 1, 2, 3, and 4, the substrate 110 is disposed in a casing of the electronic device for the components of the illumination button switch assembly 100 to be disposed thereon. An electronic circuit is disposed in a remaining part of the substrate 110, or the remaining part of the substrate 110 is connected to another printed circuit board carrying electronic components, such that the electronic circuit provides main functions of the electronic device.

Referring to FIGS. 1, 3, 4, and 5, the switch element 120 is disposed on the substrate 110. The switch element 120 can be a thin film switch, including two printed wires 121 insulated from each other. The two printed wires 121 are for being contacted simultaneously to be short-circuit, such that the substrate 110 generates a switching signal.

Referring to FIGS. 1, 3, 4, and 5, the light source 130 is disposed on the substrate 110, and is located between the two printed wires 121. The light source 130 is not directly conducted to the printed wires 121. Other circuits on the substrate 110 supply power to the light source 130, such that the light source 130 emits and projects light. The preferred implementation of the light source 130 is a light emitting diode (LED) of small volume and high luminance. However, the light source 130 can be a bulb or an electro luminescent device (ELD) of small size.

Referring to FIGS. 1, 2, 3, and 4, the supporting member 140 has a top end 141 and a bottom end 142, and the bottom end 142 is opposite to the top end 141. A concave hollow portion 144 is formed on the bottom end 142. The bottom end 142 is disposed above the switch element 120, and is separated from the switch element 120. In order to space the bottom end 142 from the switch element 120, an elastic separating portion 143 is disposed on an edge of the bottom end 142 to connect the substrate 110 and the bottom end 142, such that the bottom end 142 is normally separated from the switch element 120. The light source 130 is disposed corresponding to the hollow portion 144 to project the light into the hollow portion 144 directly. The supporting member 140 is provided to be pressed to contact the switch element 120 with the bottom end 142, such that the printing wires 121 become short-circuit, and the switch element 120 is triggered to generate the switching signal. The supporting member 140 is made of a flexible light-pervious material, for example, silicon rubber. The supporting member 140 does not need to be made of a highly transparent material, and it is only required that a part of the light from the light source 130 can pass through the supporting member 140. In addition, the supporting member 140 is monolithically formed on a connecting piece 145, such that the supporting member 140 is quickly moved and assembled through the connecting piece 145. When plural buttons are required, a plurality of supporting members 140 are monolithically formed on the connecting piece 145 at the same time, so as to install the plurality of supporting members 140 quickly on preset positions.

Referring to FIGS. 1, 2, 3, and 4, the button cap 150 is fixed on the top end 141 of the supporting member 140 to be pressed to push the supporting member 140. The supporting member 140 is pushed to contact the switch element 120 with the bottom end 142. At least a part of the button cap 150 is light-pervious, such that the light passing through the supporting member 140 further penetrates the button cap 150, so as to illuminate the button cap 150. In the embodiment of the present invention, a button mark 152 is further disposed on the button cap 150, and a part of the button cap 150 corresponding to the button mark 152 is light-pervious. The button cap 150 may be made of light-pervious material, and an opaque coating is coated on a surface of the button cap 150, but the button mark 152 is not coated by the opaque coating. The button mark 152 is coated by a light-pervious coating, or is not coated by any coating. In a alternative implementation, the button cap 150 may be completely made of opaque material, and a hollow part is formed on the button cap 150 to become the button mark 152.

Figure 2:
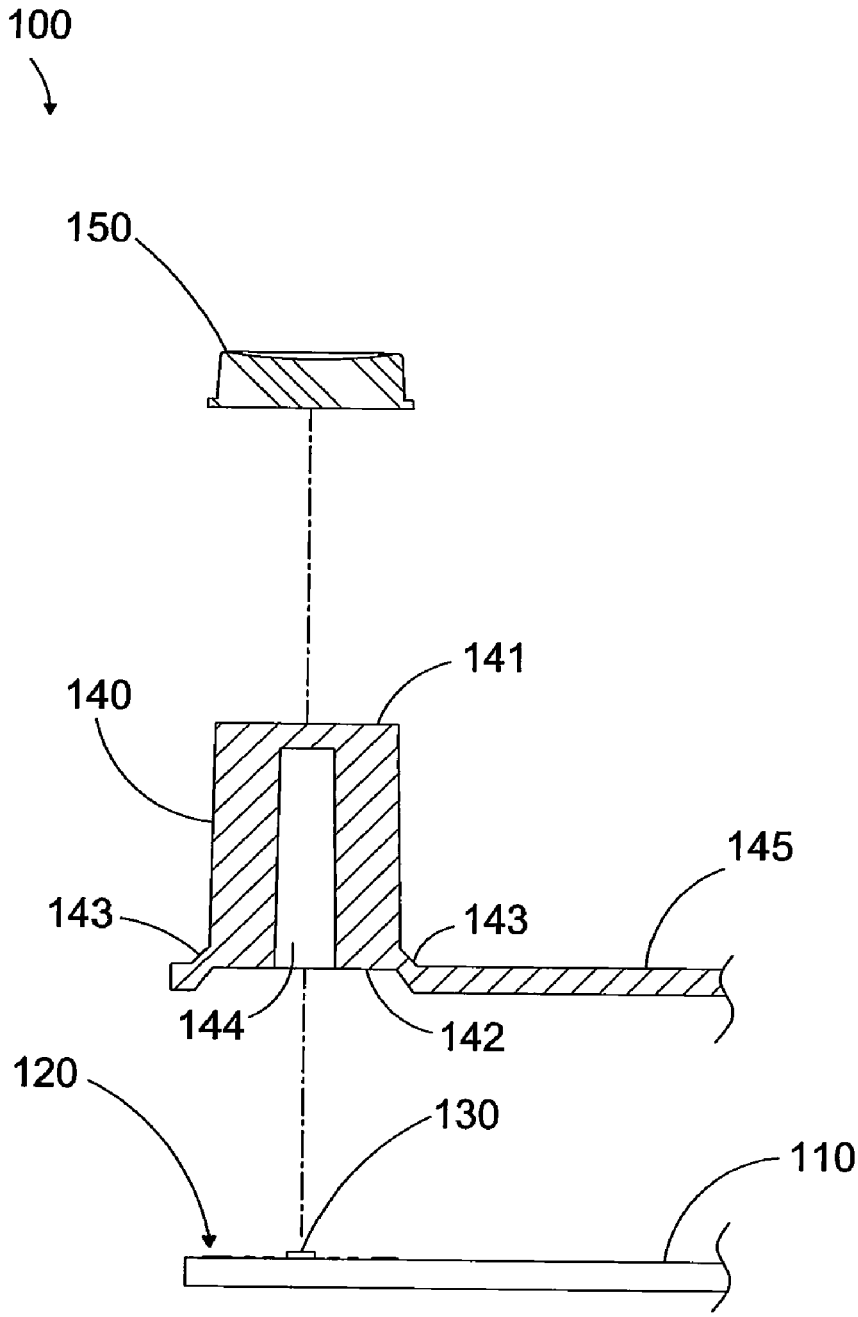
FIG. 2 is an exploded cross-sectional view according to the first embodiment of the present invention.
Figure 3:
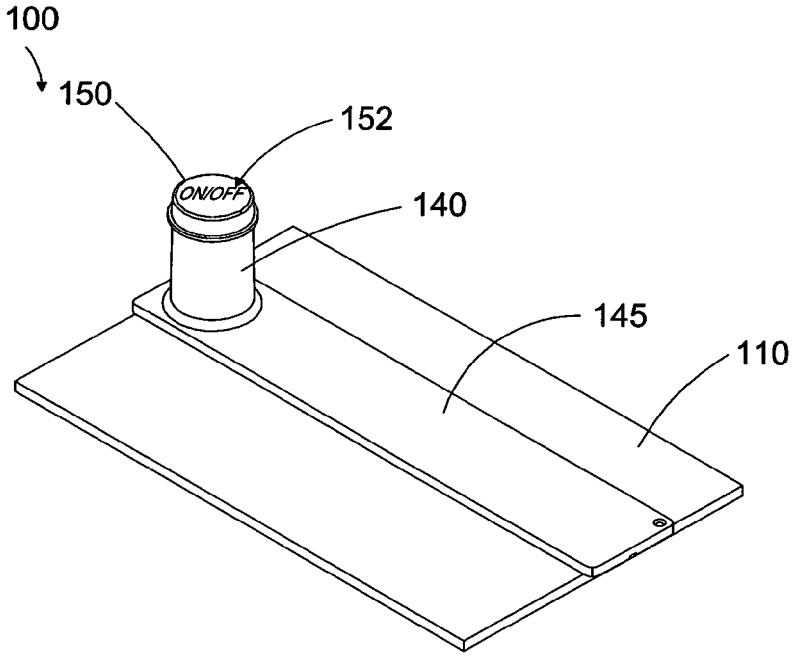
FIG. 3 is a perspective view according to the first embodiment of the present invention.
Figure 4:
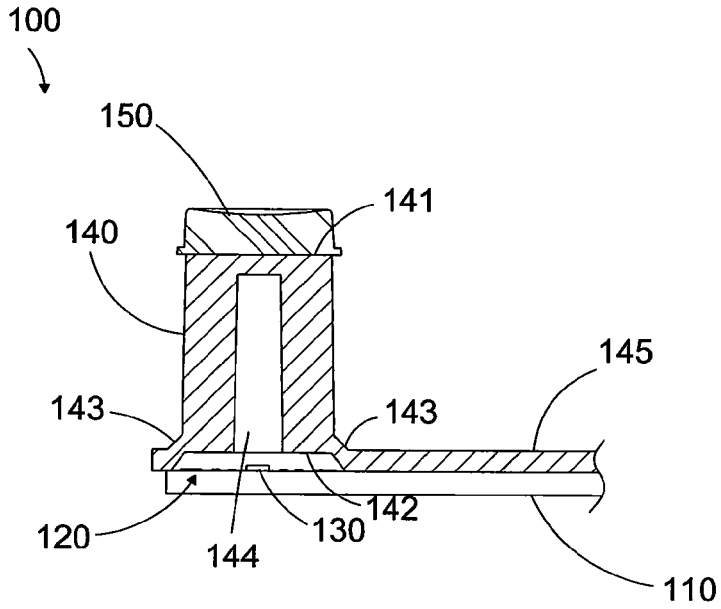
FIG. 4 is a cross-sectional view according to the first embodiment of the present invention.
Figure 5:
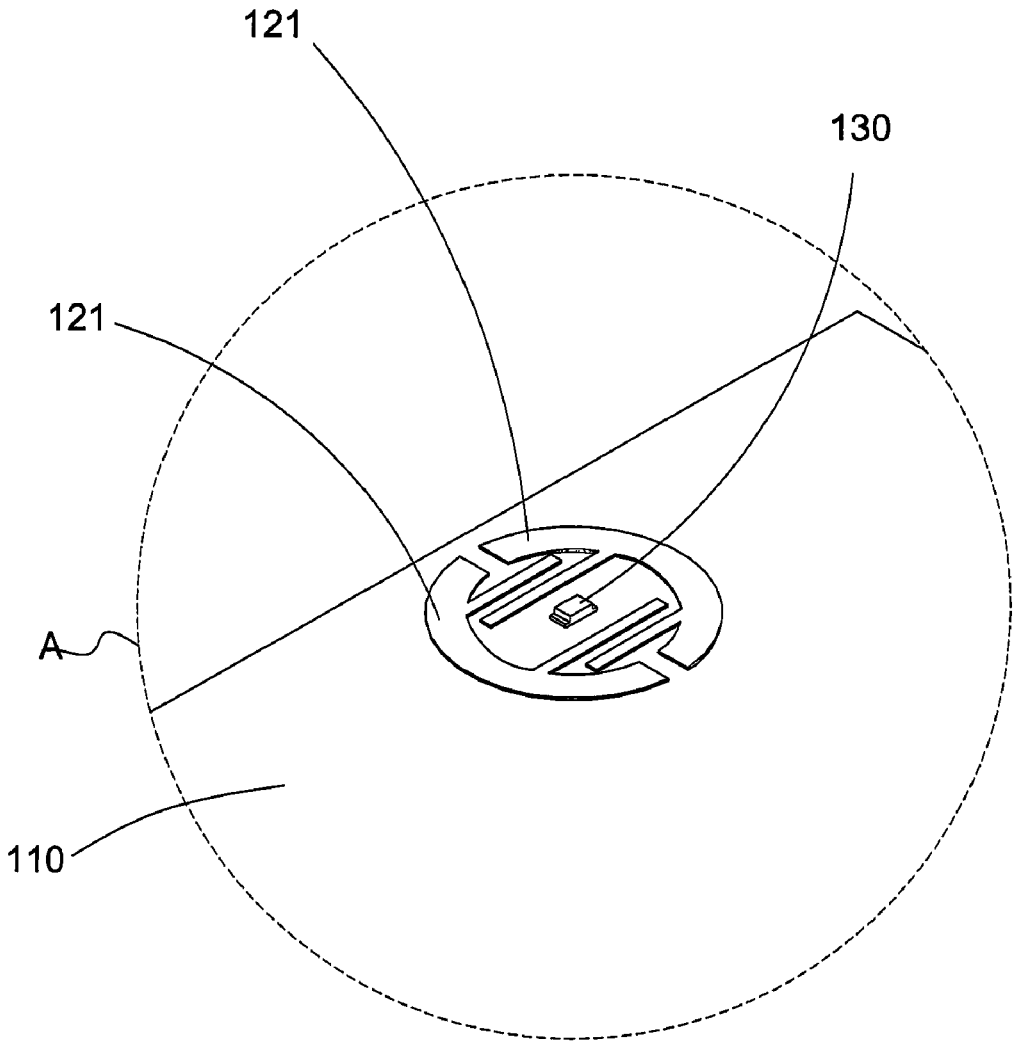
FIG. 5 is an enlarged view of area A in FIG. 1.

Referring to FIGS. 2 and 4, the bottom end 142 of the supporting member 140 is concave to form the hollow portion 144, such that a thickness of the part of the supporting member 140 at the top end 141 is greatly reduced, thereby increasing the light transmittance on the top end 141. Meanwhile, the light source 130 is disposed corresponding to the hollow portion 144, such that the light source 130 directly project light towards the button cap 150. After passing through the top end 141 of the supporting member 140, the light further penetrates the part of the button cap 150 where the button mark 152 is disposed. Therefore, when the environment is insufficiently illuminated, a top surface of the button cap 150 is sufficiently illuminated, and the button mark 152 looks like projecting light. Therefore, the user may more clearly recognize the buttons and the function (button mark) corresponding to each button. The button cap 150, the supporting member 140, and the light source 130 are approximately located in a same vertical axis, and no additional light guiding structure is required to guide light, thereby greatly reducing an area occupied by the illumination button switch assembly 100 on the substrate 110. Therefore, in the present invention, a large number of buttons may be arranged conveniently, and each key has an exclusive light source 130, so as to illuminate each button individually.

Figure 6:
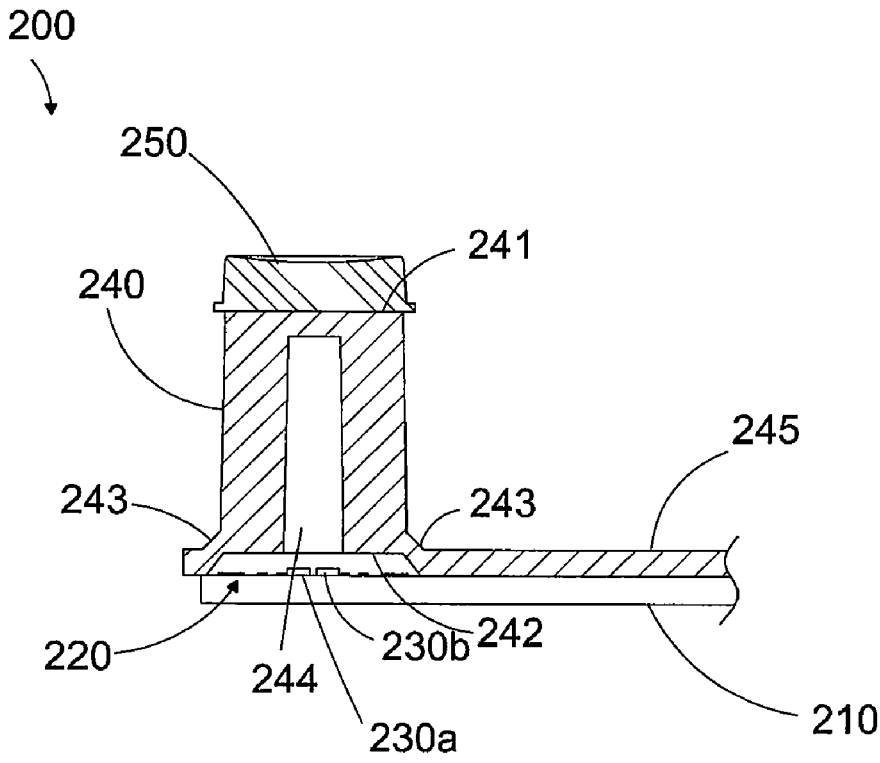
FIG. 6 is a cross-sectional view according to a second embodiment of the present invention.
Figure 7:
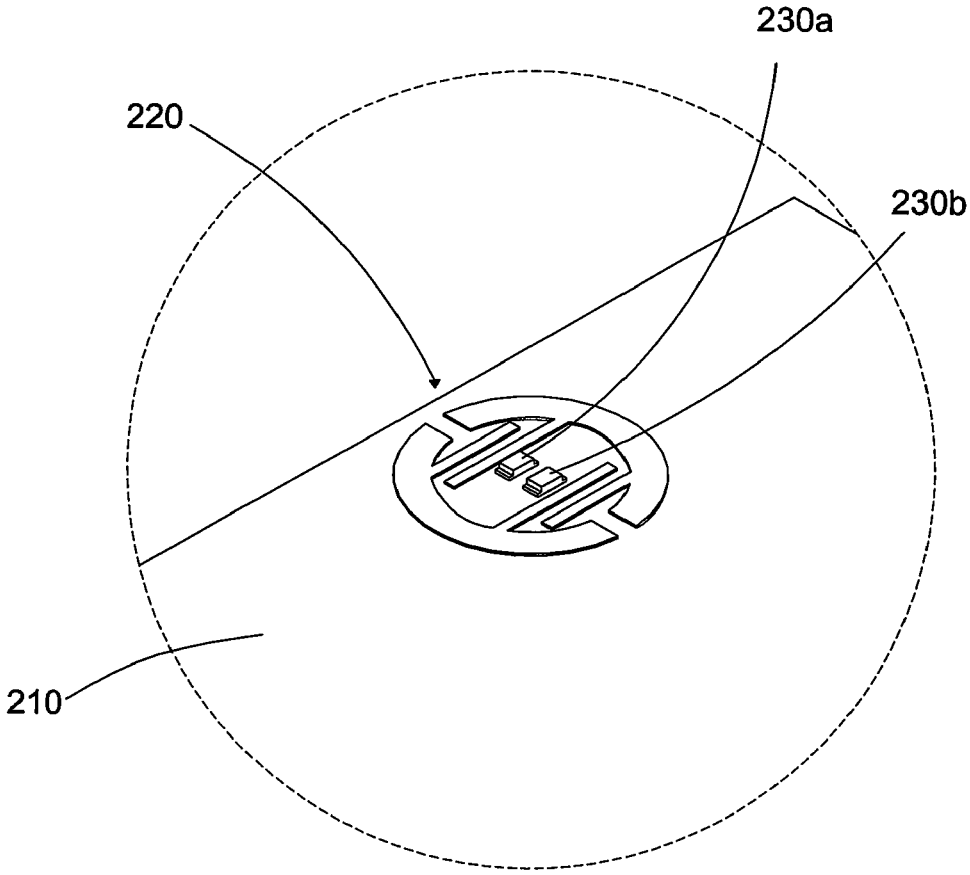
FIG. 7 is a perspective view of a part of components of the second embodiment of the present invention.

Referring to FIGS. 6 and 7, in illumination button switch assembly 200 according to a second embodiment of the present invention is applicable to an electronic device. The illumination button switch assembly 200 includes a substrate 210, a switch element 220, a plurality of light sources 230*a* and 230*b*, a flexible and light-pervious supporting member 240, and a button cap 250.

Referring to FIGS. 6 and 7, the substrate 210 is disposed in a casing of the electronic device for carrying other elements. The switch element 220 is disposed on the substrate 210, to be triggered to generate an electronic signal. The light sources 230*a* and 230*b* are disposed on the substrate 210. The supporting member 240 has a top end 241 and a bottom end 242 opposite to each other. A concave hollow portion 244 is formed on the bottom end 242 of the supporting member 240. The bottom end 242 of the supporting member 240 is disposed above the switch element 220, and is separated from the switch element 220 constantly. In order to space bottom end 242 from the switch element 220, an elastic separating portion 243 is formed on an edge of the bottom end 242 forms to connect the substrate 210 and the bottom end 244. The light sources 230*a* and 230*b* are disposed on the substrate corresponding to the hollow portion 244 to directly project light into the hollow portion 244. The supporting member 240 is monolithically formed on a connecting piece 214, such that the supporting member 240 is quickly moved and installed through moving the connecting piece 245 and fixing the connecting piece 2145 on the substrate 210. An amount of the light sources 230*a* and 230*b* depends on an area of the bottom end 242 of the supporting member 240, a sectional area of the hollow portion 244, and demands on the colors of the light. In this embodiment, two light sources 230*a* and 230*b* are used, and each of the light sources 230*a* and 230*b* respectively project light with different colors. The button cap 250 is fixed on the top end 241 of the supporting member 240, and at least a part of the button cap 250 is light-pervious, such that the light passing through the supporting member 240 may further penetrate the button cap 250, so as to illuminate the top surface of the button cap 250.

The light sources 230*a* and 230*b* project light alternately, so as to indicate related states of the electronic device. For example, when the button serves as a start button, the light source 230*a* may project red light and the light source 230*b* may project white light. When the electronic device is in a standby state (the electric power is sufficient but the device is not turned on), the light source 230*a* projects red light and the light source 230*b* does not project light. At this time, the button mark on the button cap 250 is red, so that the user knows that the button is the start button from the button mark, and knows that the electronic device is in the standby state as the button mark is red.

After the user presses the button, the illumination button switch assembly 200 generates a start signal to start the electronic device. At this time, the electronic device may turn off the light source 230*a* (which projecting red light) and turn on the light source 230*b* (which project white light), so that the user knows that the electronic device is in a start state as the button mark is white.

The aforementioned button is not limited to the start button, but may be any key on the electronic device. As the key shows different colors (the different light sources 230*a* and 230*b* are turned on alternately), the user does not need to determine the current state of the corresponding function from other interfaces, and the user recognizes the current state quickly through the color of the light illuminating the button cap 250 and the button mark.

Figure 8:
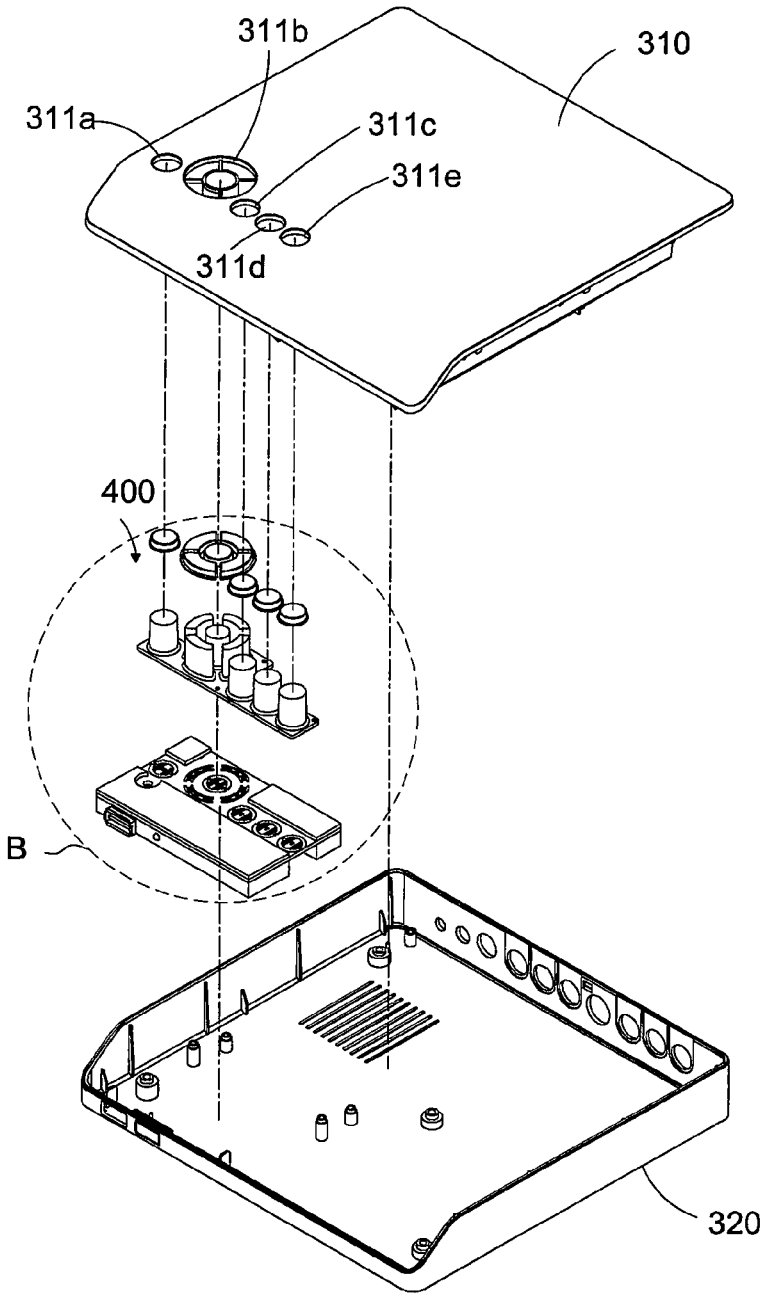
FIG. 8 is an exploded view according to a third embodiment of the present invention.
Figure 9:
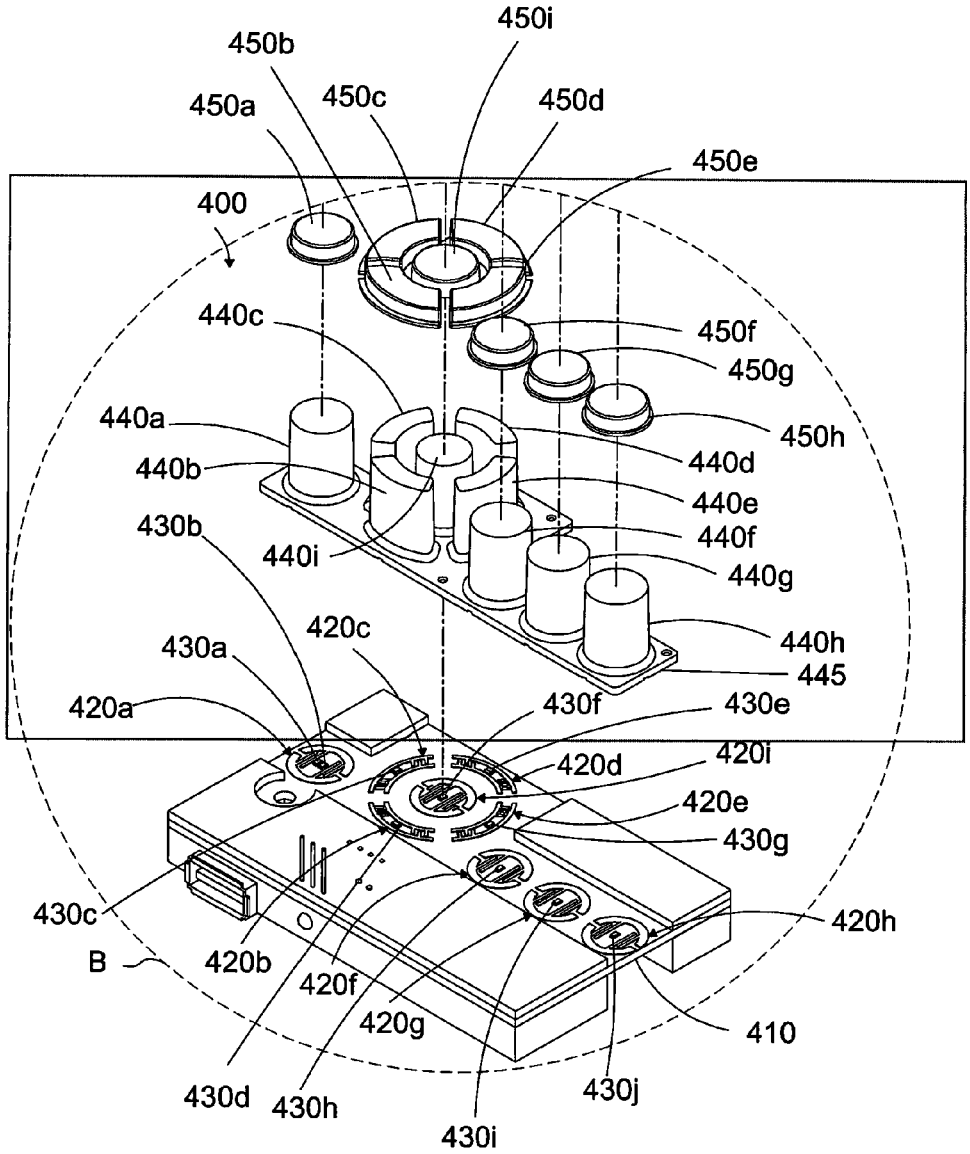
FIG. 9 is an enlarged view of area B in FIG. 8.
Figure 10:
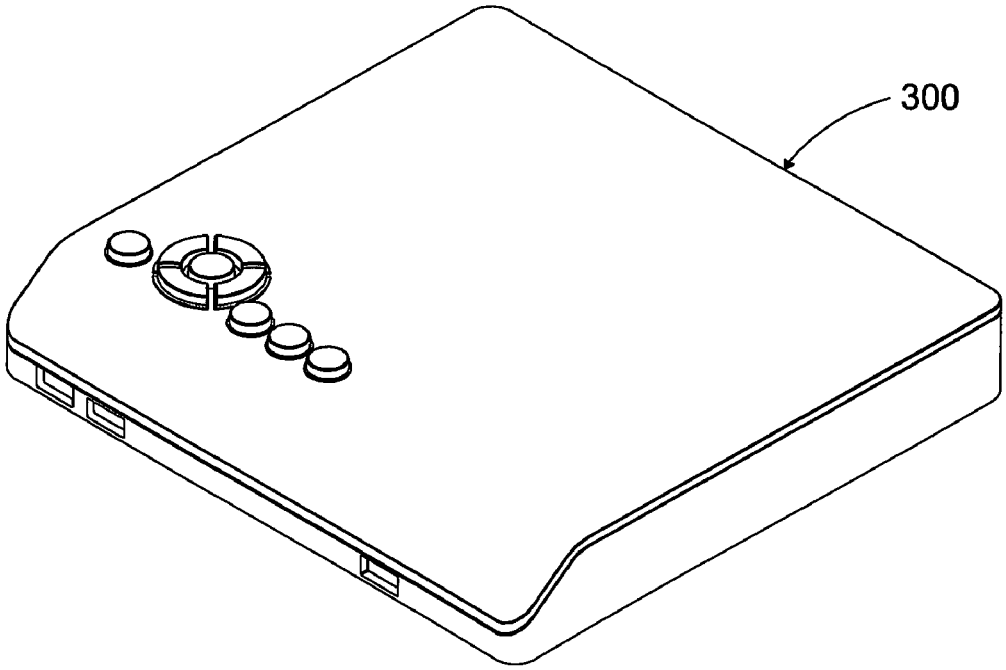
FIG. 10 is a perspective view according to the third embodiment of the present invention.

Referring to FIGS. 8, 9, and 10, an illumination button switch assembly according to a third embodiment of the present invention is shown. In the third embodiment, the present invention further provides an electronic device, which may be a multimedia playing device. The electronic device includes a casing 300 and an illumination button switch assembly 400.

Referring to FIG. 8, the casing 300 includes an upper cover 310 and a lower cover 320. The upper cover 310 and the lower cover 320 are combined with each other to form the casing 300, and the upper cover 310 has a plurality of button holes 311*a*, 311*b*, 311*c*, 311*d*, and 311*e* communicating with the inside of the casing 300.

Referring to FIGS. 8 and 9, the illumination button switch assembly 400 includes a substrate 410, a plurality of switch elements 420*a*, 420*b*, 420*c*, 420*d*, 420*e*, 420*f*, 420*g*, 420*h*, and 420*i*, a plurality of light sources 430*a*, 430*b*, 430*c*, 430*d*, 430*e*, 430*f*, 430*g*, 430*h*, 430*i*, and 430*j*, a plurality of supporting members 440*a*, 440*b*, 440*c*, 440*d*, 440*e*, 440*f*, 440*g*, 440*h*, and 440*i*, and a plurality of button caps 450*a*, 450*b*, 450*c*, 450*d*, 450*e*, 450*f*, 450*g*, 450*h*, and 450*i*. The substrate 410 is disposed in the casing 300 for carry other elements. Other electronic circuits may be further disposed on the substrate 410, or the substrate 410 is electrically connected to electronic circuits, so as to provide the main functions of the electronic device.

Referring to FIGS. 8, 9, and 10, each of the switch elements 420*a*-420*i* respectively corresponds to one of the supporting members 440*a*-440*i* and one of the button caps 450*a*-450*i*, and corresponds to one or more light sources 430*a*-430*j*. The switch elements 420*a*-420*i* are disposed on the substrate 410 to be triggered to generates corresponding switching signals. The light sources 430*a*-430*i* are disposed on the substrate 410 to project light. Each supporting member 440*a*-440*i* has a top end and a bottom end opposed to each other, and a concave hollow portion is formed on each bottom end. Each bottom end is disposed above the corresponding switch element 420*a*-420*i*, and the corresponding light source 430*a*-430*j* projects a light to the hollow portion. The supporting members 440*a*-440*i* are monolithically formed on a connecting piece 445, so as to quickly installed all the supporting members 440*a*-440*i* simultaneously.

Each of the button caps 450*a*-450*i* is fixed on the top end of one of the supporting members 440*a*-440*i*, and at least one part of each button cap 450*a*-450*i* is light-pervious, such that the light passing through the supporting members 440*a*-440*i* penetrates the button caps 450*a*-450*i*. When the upper cover 310 is combined with the lower cover 320 to form the casing 300, and the illumination button switch assembly 400 is disposed in the casing 300, each button cap 450*a*-450*i* is located in a corresponding button hole 311*a*-311*e*, such that each button cap 450*a*-450*i* is exposed out of the casing 300 for being pressed. It is not limited to dispose one button cap 450*a*-450*i* in a single button hole 311*a*-311*e*, and more than one button caps 450*a*-450*i* may be disposed in a single button hole 311*a*-311*e*.

When the button illumination function of the electronic device is activated, for example, the button illumination function is always activated, the button illumination function is activated after any of button caps 450*a*-450*i* is pressed, or the button illumination function is triggered by a specific event, the substrate 410 supplies power to a part of or all of the light sources 430*a*-430*j*, such that the powered light sources 430*a*-430*j* project light, the light passes through the hollow portions of the supporting members 440*a*-40*i*, and then penetrates the button caps 450*a*-450*i*, thereby illuminating the corresponding button caps 450*a*-450*i*, and giving prominence to the button marks of the corresponding button caps 450*a*-450*i*.

While the present invention has been described by the way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. An illumination button switch assembly for an electronic device, comprising:

a substrate;

a switch element, disposed on the substrate to be triggered to generate a switching signal, and the switch element comprising two printed wires insulated from each other;

a flexible and light-pervious supporting member, having a top end and a bottom end opposite to the top end, a concave hollow portion formed on the bottom end, and the bottom end being disposed above the switch element and spaced from the switch element, wherein the printed wires of the switch element are contacted by the bottom end of the supporting member to be short-circuit to generate the switching signal;

a light source, disposed on the substrate and corresponding to the bottom end of the supporting member and located between the two printed wires, for projecting light to the hollow portion; and a button cap, fixed on the top end of the supporting member to be pressed to push the supporting member to contact the switch element with the bottom end, at least a part of the button cap being light-pervious for the light passing through the hollow portion to penetrate the button cap.

2. The illumination button switch assembly as claimed in claim 1, wherein the light source is located between the two printed wires.

3. The illumination button switch assembly as claimed in claim 1, wherein the light source is a light emitting diode, a bulb, or an electro luminescent device.

4. The illumination button switch assembly as claimed in claim 1, wherein the supporting member is made of silicon rubber.

5. The illumination button switch assembly as claimed in claim 1, wherein an elastic separating portion is disposed on an edge of the bottom end to connect the substrate and the bottom end, such that the bottom end is separated from the switch element normally.

6. The illumination button switch assembly as claimed in claim 1, wherein the supporting member is monolithically formed on a connecting piece.

7. The illumination button switch assembly as claimed in claim 1, further comprising a button mark disposed on the button cap.

8. The illumination button switch assembly as claimed in claim 7, wherein a part of the button cap corresponding to the button mark is light-pervious.

9. The illumination button switch assembly as claimed in claim 1, wherein the illumination button switch assembly comprises at least two light sources, and each of the light sources respectively projects different colors of light.

10. The illumination button switch assembly as claimed in claim 1, wherein the illumination button switch assembly comprising a plurality of switch elements, a plurality of supporting members, a plurality of light source, and a plurality of button caps;

each of the supporting members is disposed above one of the switch elements, each of the light sources projects light to the hollow portion of one of the supporting members, and each of the button caps is fixed on the top end of one of the supporting members.

11. The illumination button switch assembly as claimed in claim 10, wherein the supporting members are monolithically formed on a connecting piece.

12. An electronic device, comprising:

a casing, having at least one button hole communicating with an internal space of the casing;

a substrate, disposed inside the casing;

at least one switch element, disposed on the substrate to be triggered to generate a switching signal, and the switch element comprising two printed wires insulated from each other;

at least one flexible and light-pervious supporting member, having a top end and a bottom end opposite to the top end, a concave hollow portion formed on the bottom end, and the bottom end being disposed above the switch element and spaced from the switch element wherein the printed wires are contacted by the bottom end of the supporting member to be short-circuit to generate the switching signal;

at least one light source, disposed on the substrate and corresponding to the bottom end of the supporting member and located between the two printed wires, for projecting light into the hollow portion; and at least one button cap, fixed on the top end of the supporting member and located in the button hole to be pressed to push the supporting member to contact the switch element with the bottom end, at least a part of the button cap being light-pervious for the light passing through the hollow portion to penetrate the button cap.

13. The electronic device as claimed in claim 12, wherein the casing comprises an upper cover and a lower cover combined to form the casing, and the button hole is disposed on the upper cover.

14. The electronic device as claimed in claim 12, wherein the light source is a light emitting diode, a bulb, or an electro luminescent device.

15. The electronic device as claimed in claim 12, wherein the supporting member is made of silicon rubber.

16. The electronic device as claimed in claim 12, wherein an elastic separating portion is disposed on an edge of the bottom end to connect the substrate and the bottom end, such that the bottom end is separated from the switch element normally.

17. The electronic device as claimed in claim 12, wherein the supporting member is monolithically formed on a connecting piece.

18. The electronic device as claimed in claim 12, further comprising a button mark disposed on the button cap.

19. The electronic device as claimed in claim 18, wherein a part of the button cap corresponding to the button mark is light-pervious.

20. The electronic device as claimed in claim 12, wherein the illumination button switch assembly comprises at least two light sources, and each of the light sources respectively projects different colors of light.

21. The electronic device as claimed in claim 12, wherein the illumination button switch assembly comprising a plurality of switch elements, a plurality of supporting members, a plurality of light source, and a plurality of button caps;

each of the supporting members is disposed above one of the switch elements, each of the light sources projects light to the hollow portion of one of the supporting members, and each of the button caps is fixed on the top end of one of the supporting members.

22. The electronic device as claimed in claim 21, wherein the supporting members are monolithically formed on a connecting piece.

23. An illumination button switch assembly for an electronic device, comprising:

a substrate;

a switch element, disposed on the substrate to be triggered to generate a switching signal;

a flexible and light-pervious supporting member, having a top end and a bottom end opposite to the top end, a concave hollow portion formed on the bottom end, an elastic separating portion disposed on an edge of the bottom end to connect the substrate and the bottom end, and the bottom end being disposed above the switch element and spaced from the switch element;

a light source, disposed on the substrate and corresponding to the bottom end of the supporting member, for projecting light to the hollow portion; and a button cap, fixed on the top end of the supporting member to be pressed to push the supporting member to contact the switch element with the bottom end, at least a part of the button cap being light-pervious for the light passing through the hollow portion to penetrate the button cap.

24. An electronic device, comprising:

a casing, having at least one button hole communicating with an internal space of the casing;

a substrate, disposed inside the casing;

at least one switch element, disposed on the substrate to be triggered to generate a switching signal;

at least one flexible and light-pervious supporting member, having a top end and a bottom end opposite to the top end, a concave hollow portion formed on the bottom end, an elastic separating portion disposed on an edge of the bottom end to connect the substrate and the bottom end, and the bottom end being disposed above the switch element and spaced from the switch element;

at least one light source, disposed on the substrate and corresponding to the bottom end of the supporting member, for projecting light into the hollow portion; and at least one button cap, fixed on the top end of the supporting member and located in the button hole to be pressed to push the supporting member to contact the switch element with the bottom end, at least a part of the button cap being light-pervious for the light passing through the hollow portion to penetrate the button cap.

* * * * *